US011056786B2

(12) United States Patent
Zhu et al.

(10) Patent No.: US 11,056,786 B2
(45) Date of Patent: Jul. 6, 2021

(54) ANTENNA SYSTEM AND MOBILE TERMINAL

(71) Applicant: AAC Technologies Pte. Ltd., Singapore (SG)

(72) Inventors: Yufei Zhu, Shenzhen (CN); Yongsheng Peng, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,084

(22) Filed: Jul. 28, 2019

(65) Prior Publication Data

US 2020/0044339 A1 Feb. 6, 2020

(30) Foreign Application Priority Data

Aug. 3, 2018 (CN) ..... 201810880128.X

(51) Int. Cl.
*H01Q 5/30* (2015.01)
*H01Q 21/30* (2006.01)
*H01Q 1/24* (2006.01)

(52) U.S. Cl.
CPC ..... *H01Q 5/30* (2015.01); *H01Q 1/243* (2013.01); *H01Q 21/30* (2013.01)

(58) Field of Classification Search
CPC ..... H01Q 5/30; H01Q 21/30; H01Q 1/243; H01Q 21/28; H01Q 1/22; H01Q 21/061
USPC ..... 343/702
See application file for complete search history.

(56) References Cited

U.S. PATENT DOCUMENTS

2010/0127949 A1* 5/2010 Shimizu ..... H01Q 21/26 343/810
2010/0227646 A1* 9/2010 Ogawa ..... H01Q 21/24 455/562.1
2018/0316088 A1* 11/2018 Wen ..... H01Q 1/38
2018/0366812 A1* 12/2018 Kim ..... H01Q 13/106
2019/0214722 A1* 7/2019 Di Paola ..... H01Q 3/24
2019/0229413 A1* 7/2019 Jong ..... H01Q 21/28
2020/0021015 A1* 1/2020 Yun ..... H01Q 1/38
2020/0044339 A1* 2/2020 Zhu ..... H01Q 5/30
2020/0076055 A1* 3/2020 Jeon ..... H01Q 21/06
2020/0153115 A1* 5/2020 Yun ..... H01Q 3/36

* cited by examiner

*Primary Examiner* — Don P Le
(74) *Attorney, Agent, or Firm* — W&G Law Group LLP

(57) ABSTRACT

The present disclosure provides an antenna system including a non-metallic housing. The non-metallic housing includes a top edge portion, a bottom edge portion provided correspondingly to the top edge portion, and a first long side edge portion and a second long side edge portion that connect the top edge portion with the bottom edge portion. The antenna system further includes seven antenna units provided on a periphery of the non-metallic housing. Compared with the related art, the antenna system provided by the present disclosure, by providing seven antenna units on the periphery of the non-metallic housing, achieves 3.3-3.6 GHz-4×4 MIMO, WIFI-2×2 MIMO, GPS, and 2G, 3G and 4G mobile communications.

6 Claims, 12 Drawing Sheets

ANTENNA SYSTEM AND MOBILE TERMINAL

TECHNICAL FIELD

The present disclosure relates to the field of antenna technologies, and in particular, to an antenna system and a mobile terminal.

BACKGROUND

In wireless communication devices, there is always a device that radiates electromagnetic energy into space and receives electromagnetic energy from space, and this device is an antenna. The role of the antenna is to transmit a digital or analog signal modulated onto a radio frequency (RF) frequency to a spatial wireless channel, or to receive a digital or analog signal modulated onto a RF frequency from a spatial wireless channel.

The existing wireless communication devices have more and more requirements on antenna operating bands, such that an increasingly complex internal antenna design is required. However, the existing wireless communication devices, such as mobile phones, are becoming thinner, making the available space for the antenna smaller and smaller, which is difficult for the antenna to cover sufficient bands.

Therefore, it is necessary to provide a novel antenna system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
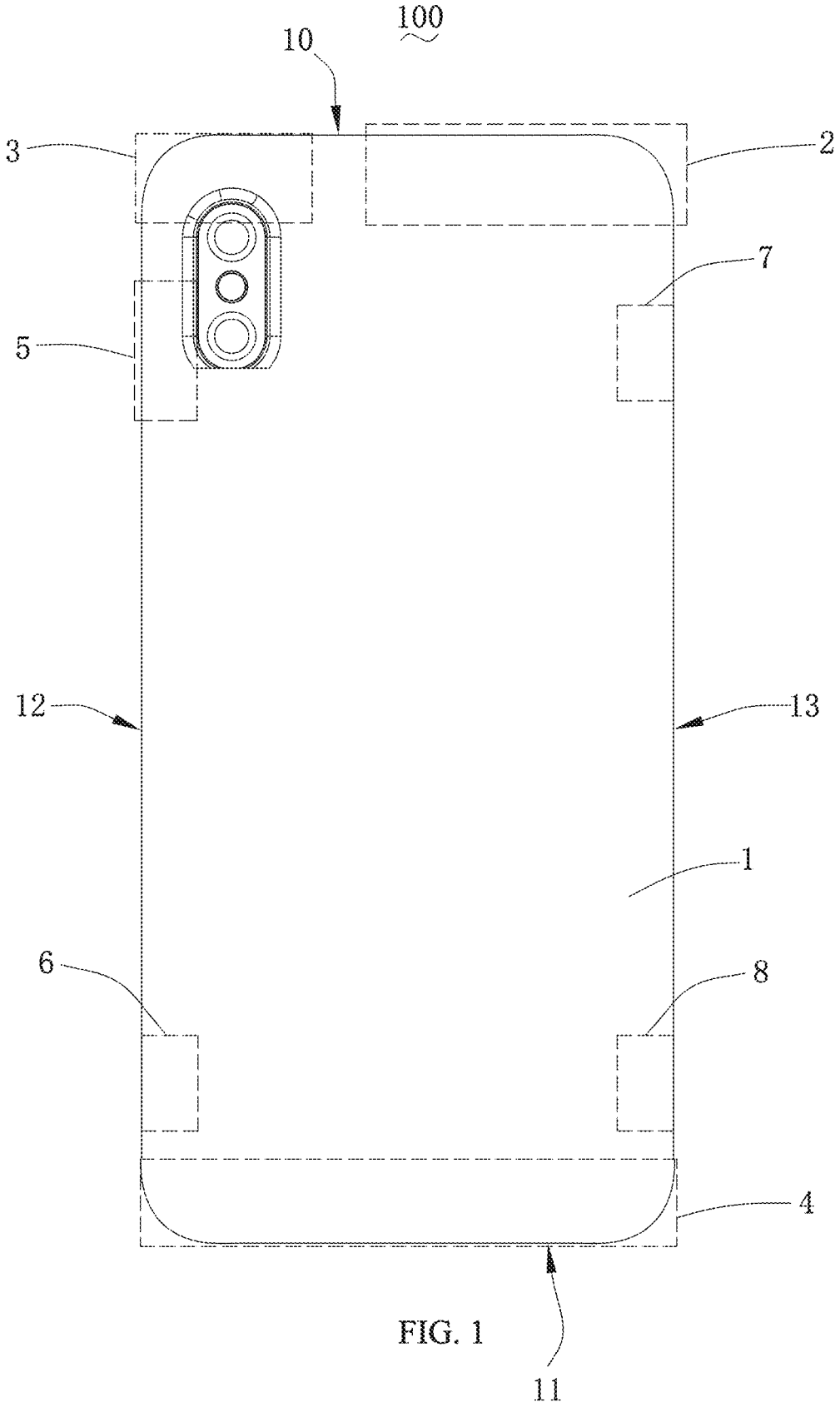
FIG. 1 is a structural schematic diagram of an antenna system of the present disclosure when viewed in a first perspective.

Referring to FIG. 1, an embodiment of the present disclosure provides an antenna system 100, which can be applied to a mobile communication terminal such as a mobile phone. The antenna system 100 includes a non-metallic housing 1. The non-metallic housing 1 includes a top edge portion 10, a bottom edge portion 11 provided correspondingly to the top edge portion 10, and a first long side edge portion 12 and a second long side edge portion 13 that connect the top edge portion 10 with the bottom edge portion 11. In a preferred embodiment of the present disclosure, the non-metallic housing 1 is a plastic housing and does not have a shielding effect on radio waves.

Figure 2:
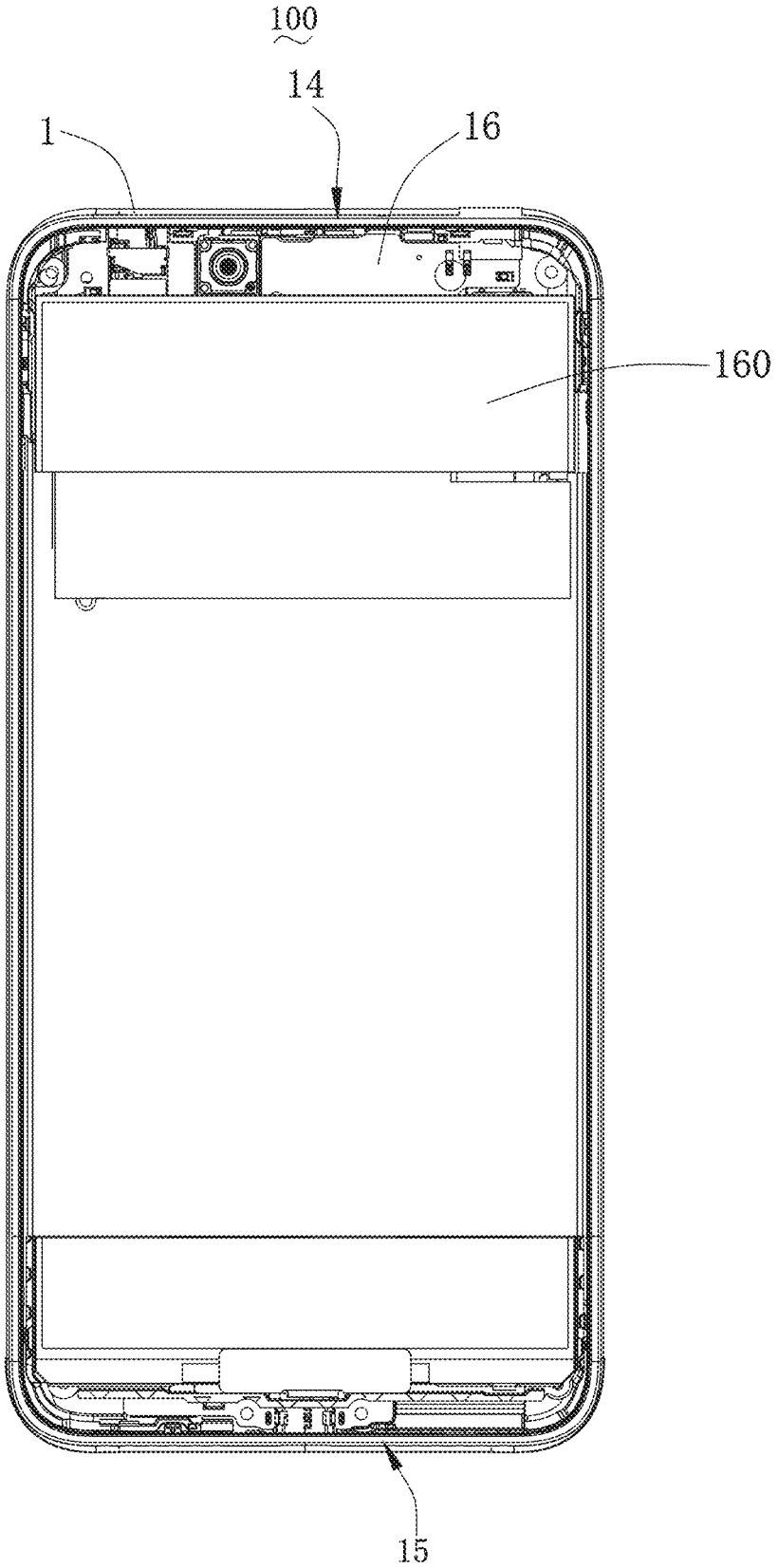
FIG. 2 is a structural schematic diagram of an antenna system of the present disclosure when viewed in a second perspective.

Referring to FIG. 2 in conjunction, the antenna system 100 further includes a top clearance region 14 provided correspondingly to the top edge portion 10 and a bottom clearance region 15 provided correspondingly to the bottom edge portion 11. The top clearance region 14 has a width of 6.2 mm, and the bottom clearance region 15 has a width of 3.8 mm. The antenna system 100 further includes a circuit board 16 provided in the non-metallic housing 1. The circuit board 16 is provided with a system ground 160. A width of the clearance region 14 refers to a distance from the system ground 160 on the circuit board 16 to the bottom edge portion 11 or the top edge portion 10 of the non-metallic housing 1 along a length direction of the non-metallic housing 1.

The antenna system 100 further includes a first antenna unit 2, a second antenna unit 3, a third antenna unit 4, a fourth antenna unit 5, a fifth antenna unit 6, a sixth antenna unit 7 and a seventh antenna unit 8, which are arranged to correspond to the periphery of the non-metallic housing 1 and are spaced apart from each other. By properly selecting antenna types and operating bands of the above seven antenna units, the antenna system 100 can cover multiple bands. Moreover, the structure of each antenna unit can be designed to be simpler so as to reduce design cost.

Figure 3A:
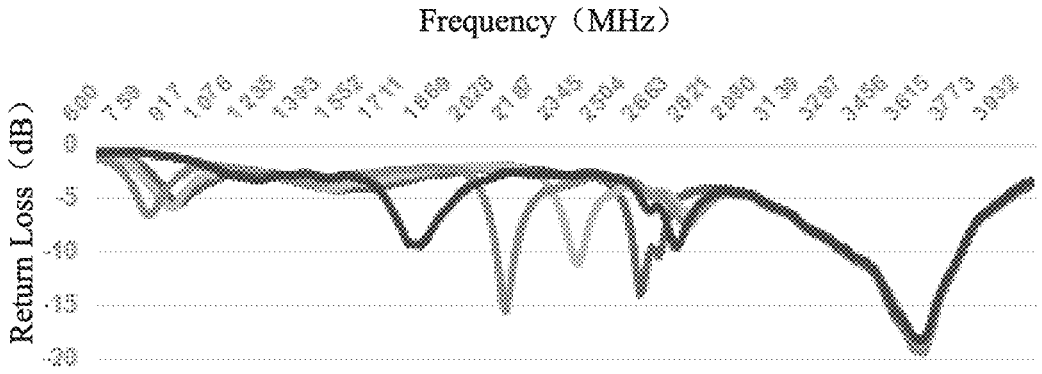
FIG. 3A is a return loss graph of a first antenna unit of an antenna system of the present disclosure.
Figure 3B:
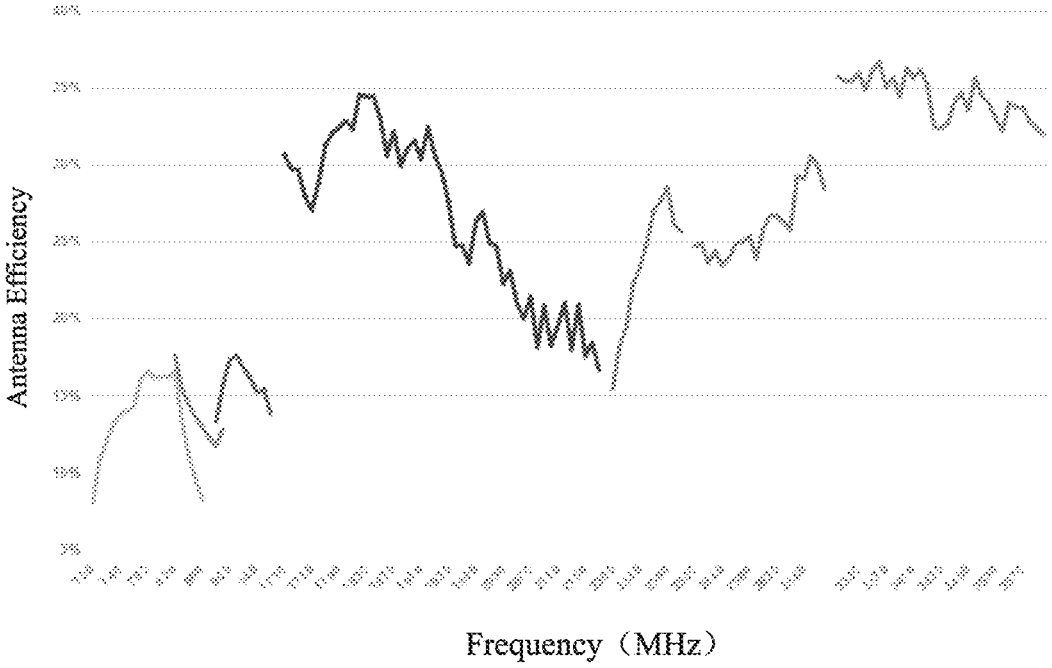
FIG. 3B is an antenna efficiency graph of a first antenna unit of an antenna system of the present disclosure.

The first antenna unit 2 is provided correspondingly to the top edge portion 10. Specifically, the first antenna unit 2 is a 3.3-3.6 GHz-4×4 MIMO antenna and has coverage bands of 790-960 MHz, 1710-2690 MHz and 3.3-3.6 GHz. The return loss and antenna efficiency in the coverage bands of the first antenna unit 2 are illustrated in FIGS. 3A and B.

The second antenna unit 3 is provided correspondingly to the top position and spaced apart from the first antenna unit.

Figure 4A:
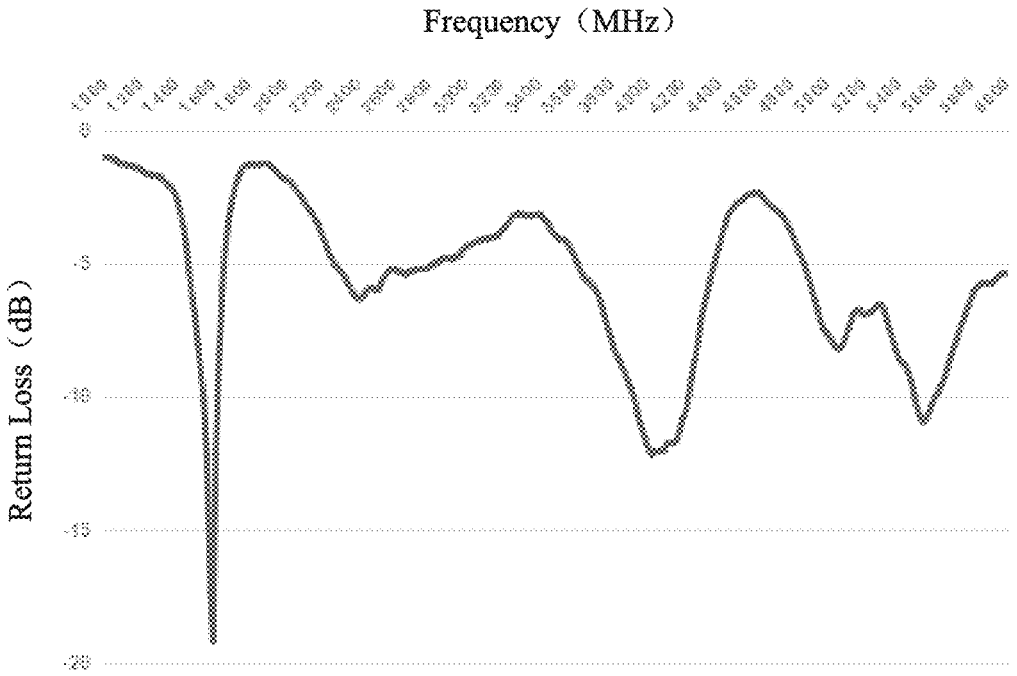
FIG. 4A is a return loss graph of a second antenna unit of an antenna system of the present disclosure.
Figure 4B:
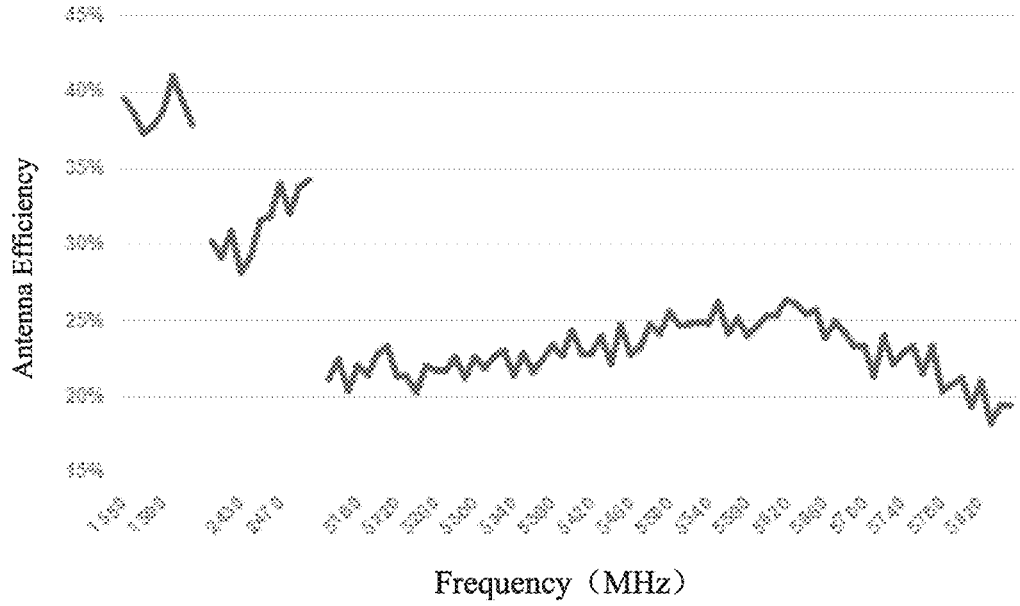
FIG. 4B is an antenna efficiency graph of a second antenna unit of an antenna system of the present disclosure.

Specifically, the second antenna unit 3 is a WIFI-2×2 MIMO antenna, and has coverage bands of 1550-1620 MHz, 2400-2500 MHz and 5.15-5.85 GHz. The return loss and antenna efficiency in the coverage bands of the second antenna unit 3 are illustrated in FIGS. 4A and B.

Figure 5A:
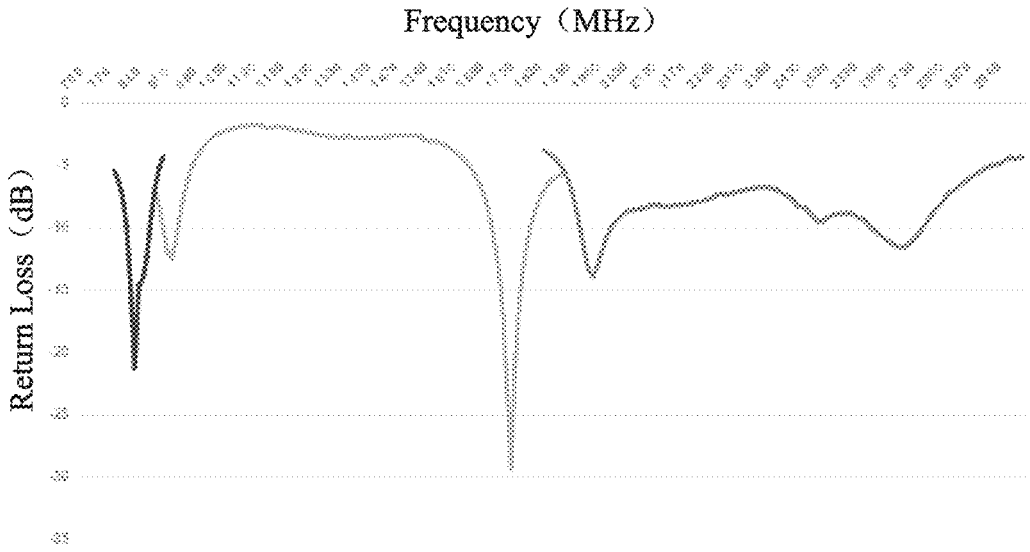
FIG. 5A is a return loss graph of a third antenna unit of an antenna system of the present disclosure.
Figure 5B:
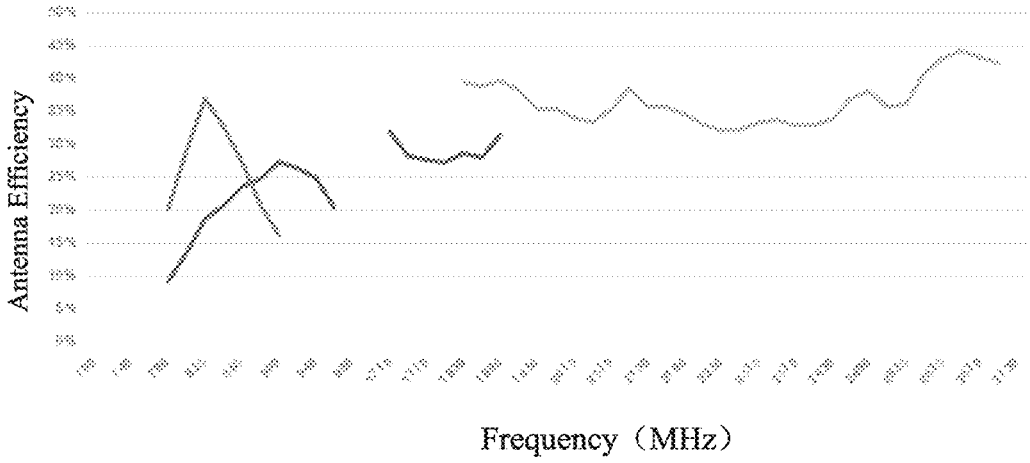
FIG. 5B is an antenna efficiency graph of a third antenna unit of an antenna system of the present disclosure.

The third antenna unit 4 is provided correspondingly to the bottom position. Specifically, the third antenna unit 4 is a main antenna, and has coverage bands of 790-960 MHz and 1710-2690 MHz. The return loss and antenna efficiency in the coverage bands of the third antenna unit 4 are illustrated in FIGS. 5A and B.

Figure 6A:
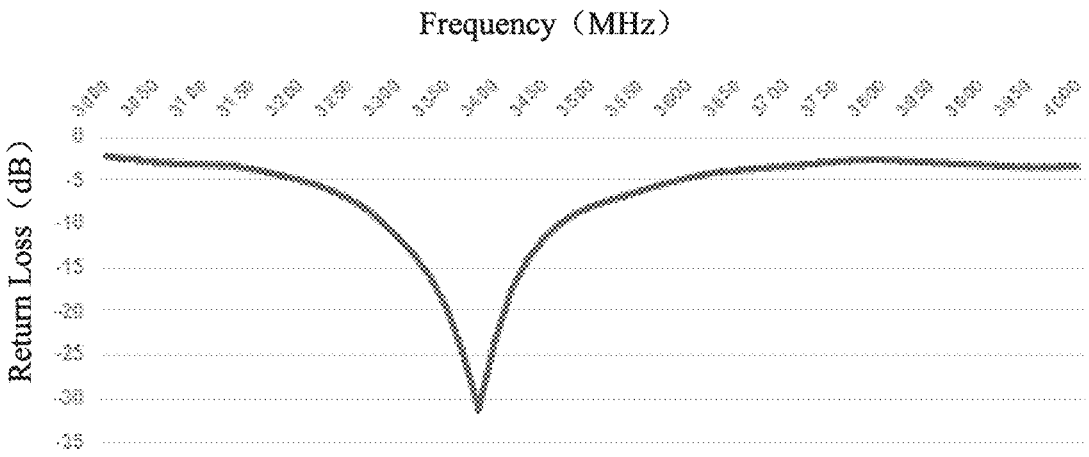
FIG. 6A is a return loss graph of a fourth antenna unit of an antenna system of the present disclosure.
Figure 6B:
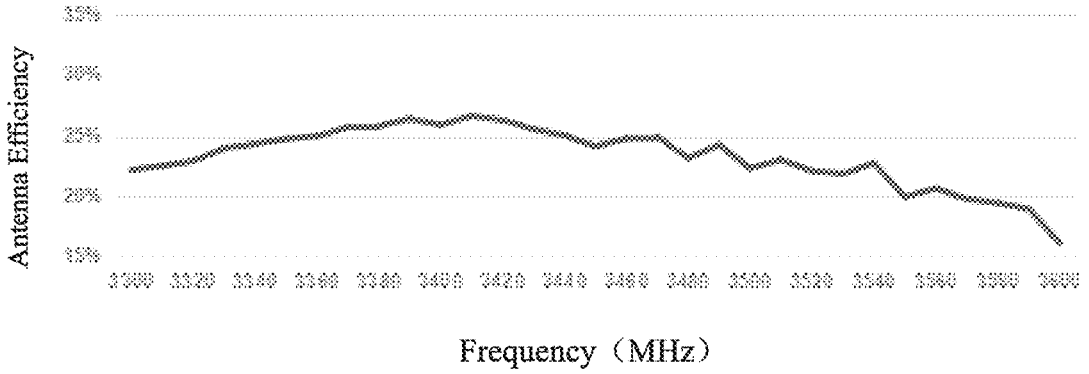
FIG. 6B is an antenna efficiency graph of a fourth antenna unit of an antenna system of the present disclosure.

The fourth antenna unit 5 is provided correspondingly to the first long side edge portion and close to the second antenna unit. Specifically, the fourth antenna unit 5 is a 3.3-3.6 GHz-4×4 MIMO antenna, and has a coverage band of 3.3-3.6 GHz. The return loss and antenna efficiency in the coverage band of fourth antenna unit 5 are illustrated in FIGS. 6A and B.

Figure 7A:
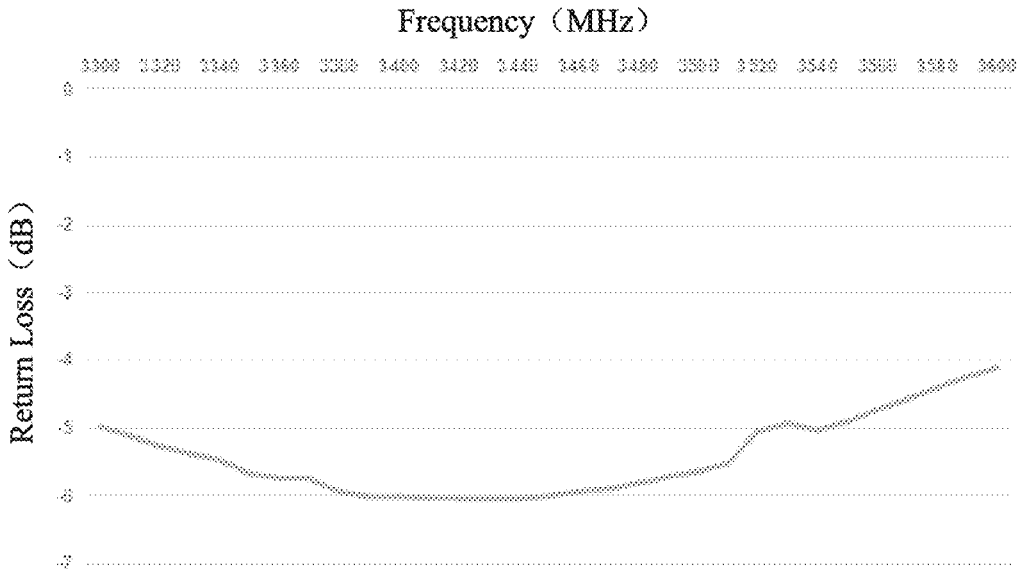
FIG. 7A is a return loss graph of a fifth antenna unit of an antenna system of the present disclosure.
Figure 7B:
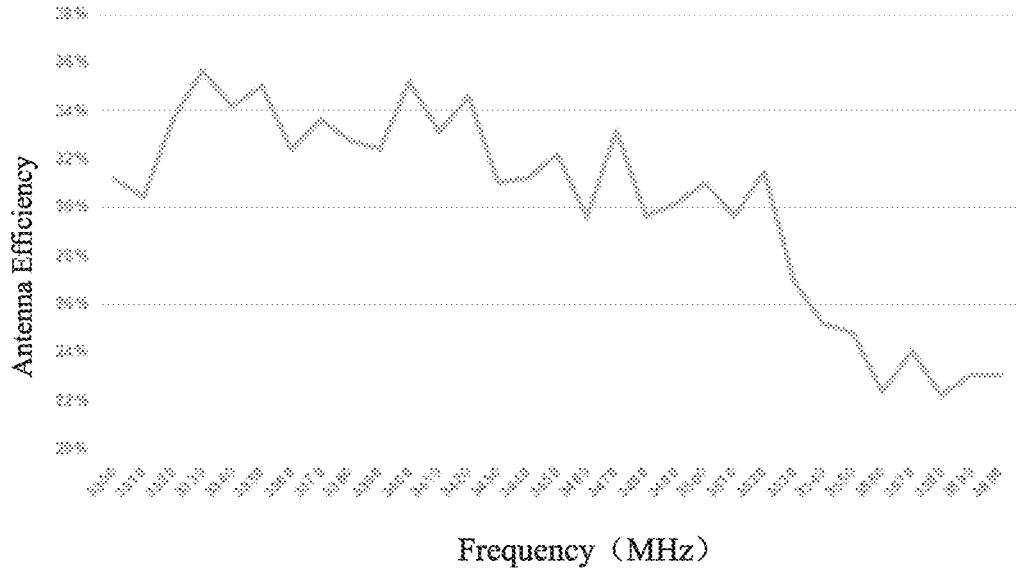
FIG. 7B is an antenna efficiency graph of a fifth antenna unit of an antenna system of the present disclosure.

The fifth antenna unit 6 is provided correspondingly to the first long side edge portion and close to the third antenna unit. Specifically, the fifth antenna unit 6 is a 3.3-3.6 GHz-4×4 MIMO antenna, and has a coverage band of 3.3-3.6 GHz. The return loss and antenna efficiency in the coverage band of fifth antenna unit 6 are illustrated in FIGS. 7A and B.

Figure 8A:
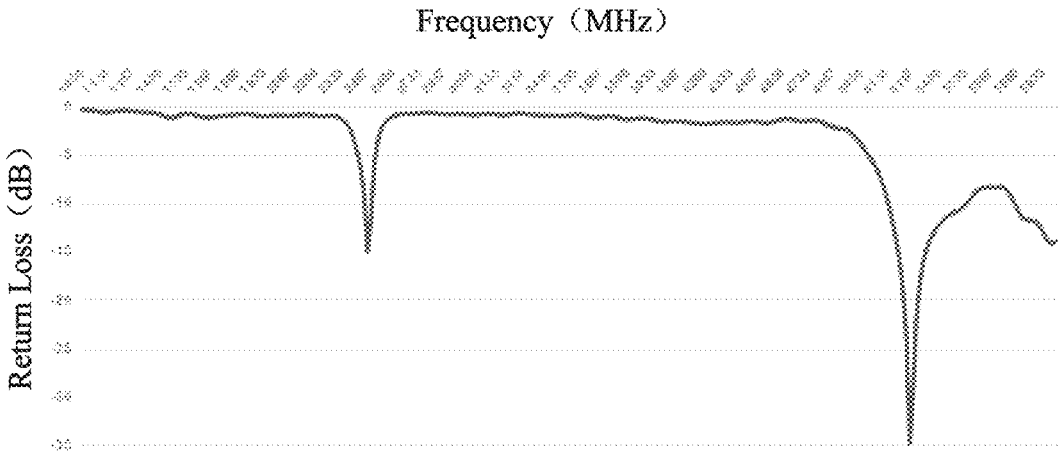
FIG. 8A is a return loss graph of a sixth antenna unit of an antenna system of the present disclosure.
Figure 8B:
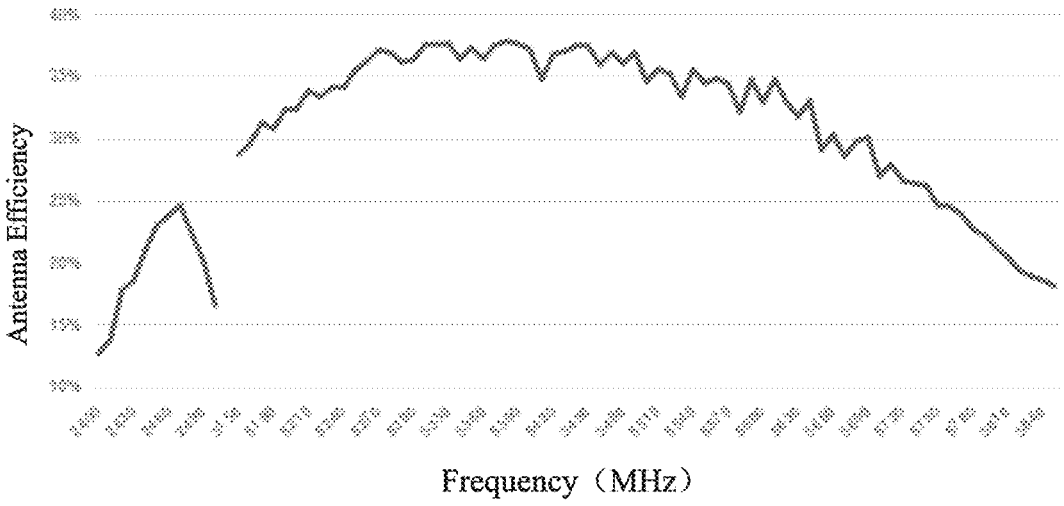
FIG. 8B is an antenna efficiency graph of a sixth antenna unit of an antenna system of the present disclosure.

The sixth antenna unit 7 is provided correspondingly to the second long side edge portion and close to the first antenna unit. Specifically, the sixth antenna unit 7 is a WIFI-2×2 MIMO antenna, and has coverage bands of 2400-2500 MHz and 5.15-5.85 GHz. The return loss and antenna efficiency in the coverage bands of sixth antenna unit 7 are illustrated in FIGS. 8A and B.

Figure 9A:
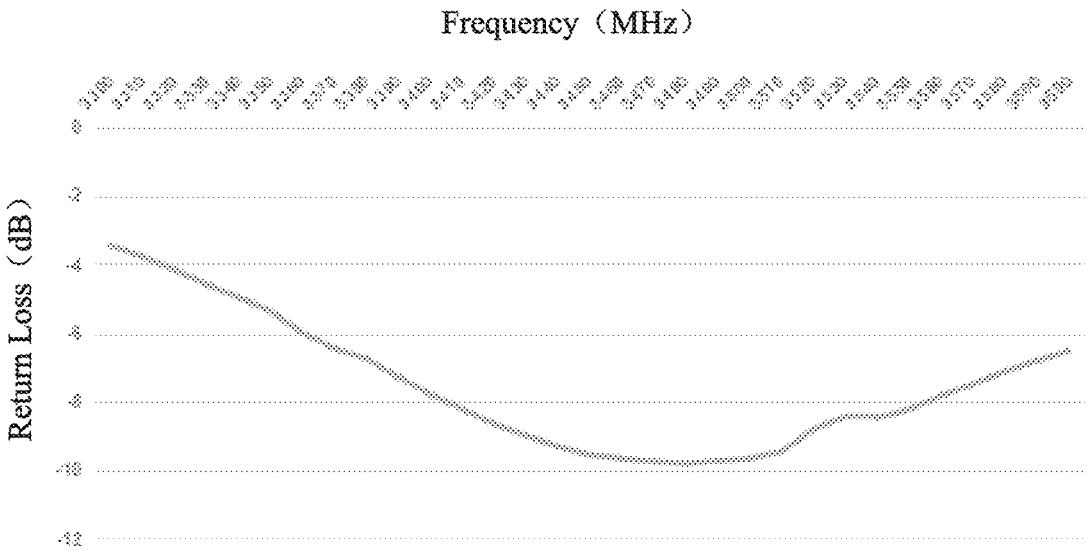
FIG. 9A is a return loss graph of a seventh antenna unit of an antenna system of the present disclosure.
Figure 9B:
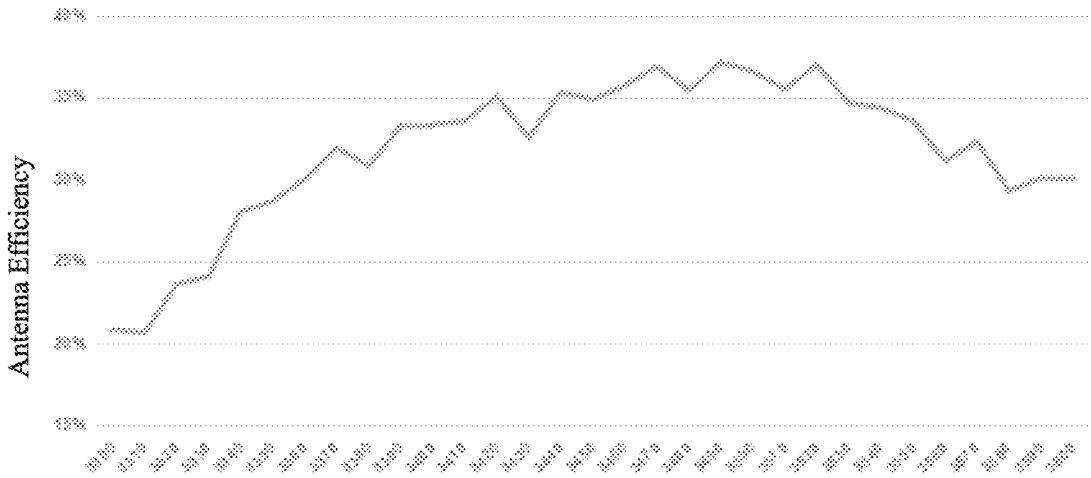
FIG. 9B is an antenna efficiency graph of a seventh antenna unit of an antenna system of the present disclosure.

The seventh antenna unit 8 is provided correspondingly to the second long side edge portion and close to the third antenna unit. Specifically, the seventh antenna unit 8 is a 3.3-3.6 GHz-4×4 MIMO antenna, and has a coverage band of 3.3-3.6 GHz. The return loss and antenna efficiency in the coverage band of seventh antenna unit 8 are illustrated in FIGS. 9A and B.

Figure 11:
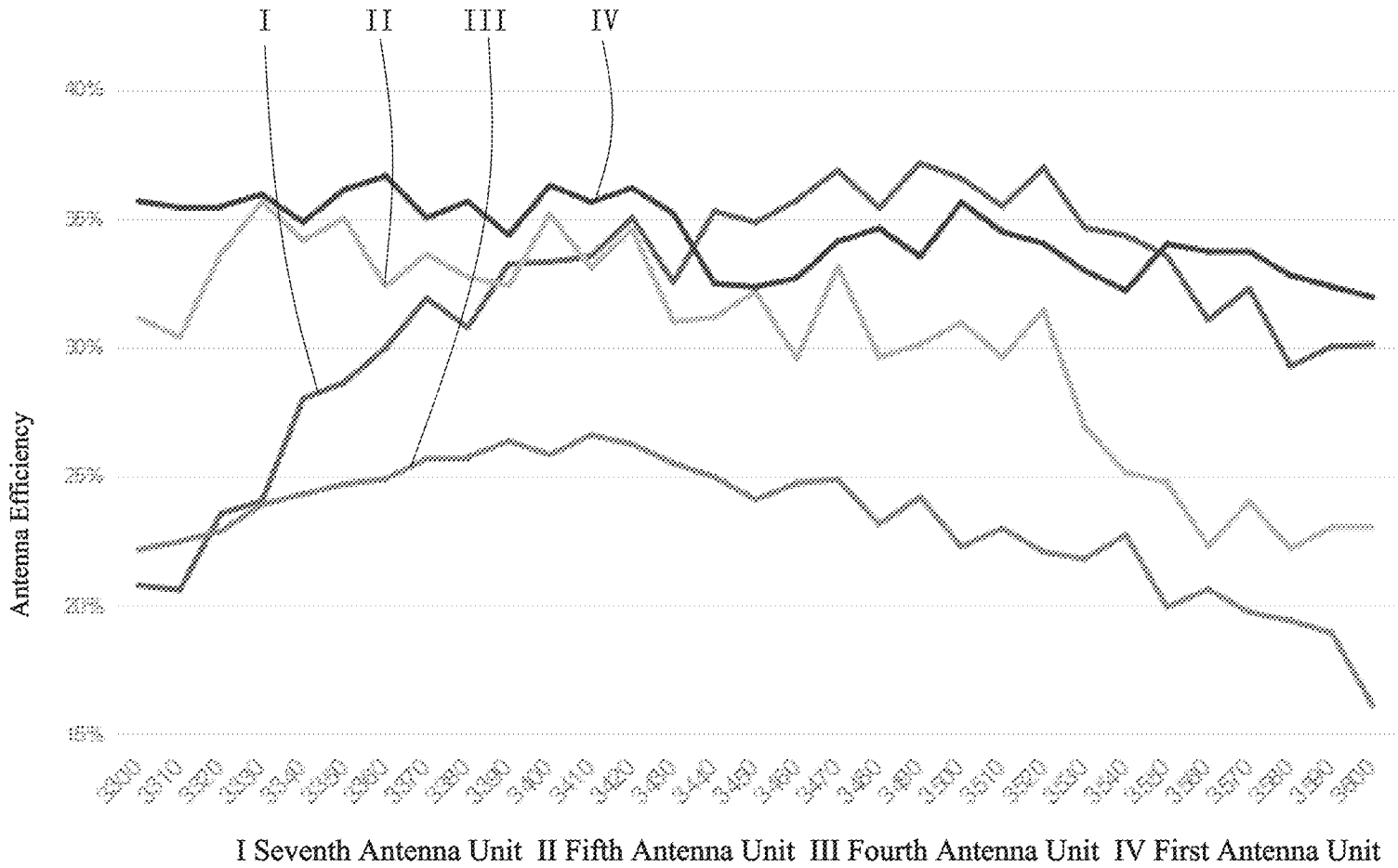
FIG. 11 is an antenna efficiency graph of a 3.3-3.6 GHz-4×4 MIMO formed by a first antenna unit, a fourth antenna unit, a fifth antenna unit, and a seventh antenna unit of the antenna system of the present disclosure.

It can be seen that, the first antenna unit 2, the fourth antenna unit 5, the fifth antenna unit 6, and the seventh antenna unit 8 that are included in the antenna system 10 provided by the present disclosure are all 3.3-3.6 GHz-4×4 MIMO antennas, and each of them covers a band of 3.5 G (3.3-3.6 GHz). The average antenna efficiency of each antenna unit is shown in Table 1 below. Reference can be made to FIG. 11 for details.

TABLE 1

| Frequency (MHz) | 3300-3600 |
|---|---|
| Seventh antenna unit | 32% |
| Fifth antenna unit | 30% |
| Fourth antenna unit | 23% |
| First antenna unit | 34% |

Figure 12:
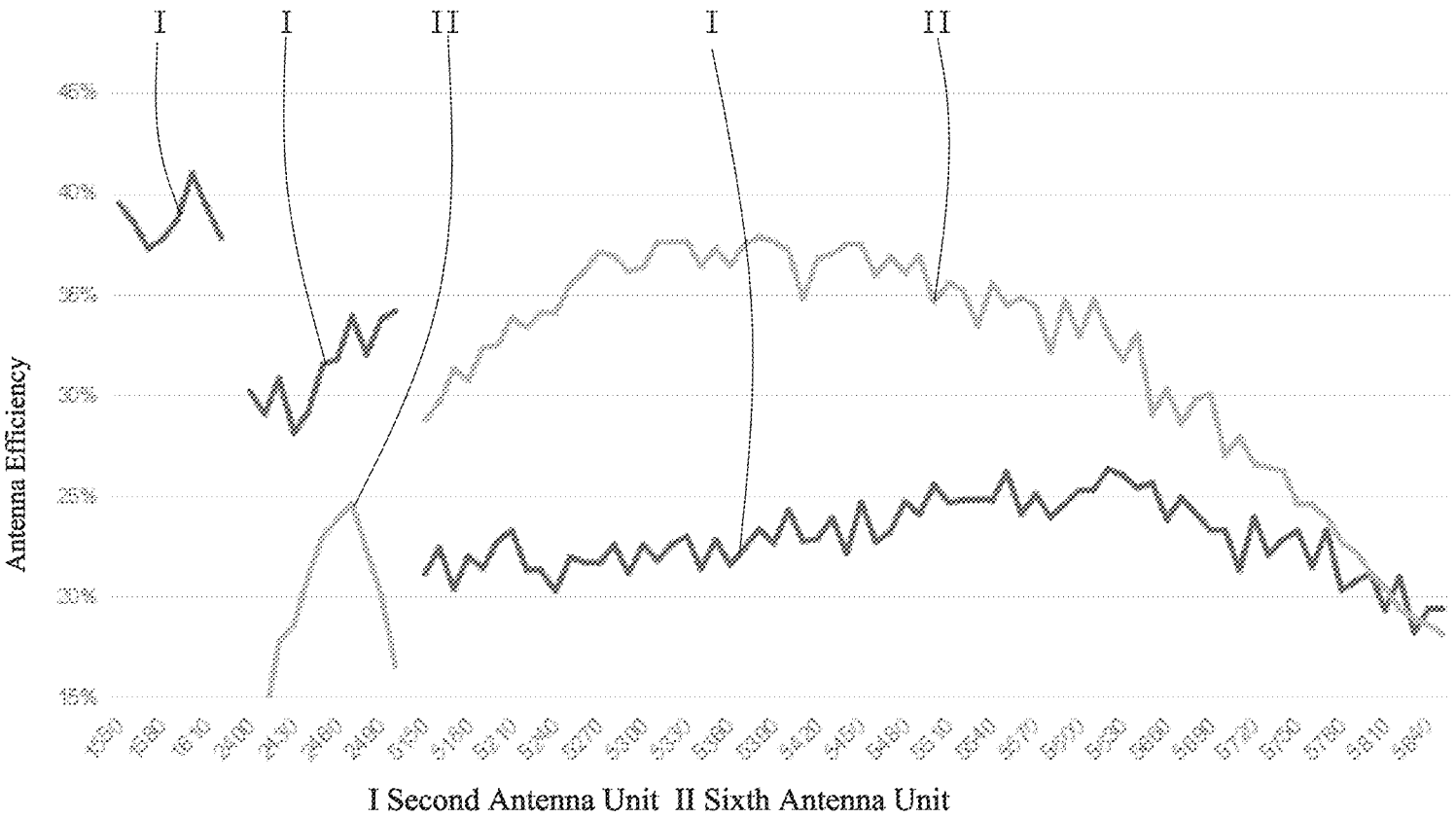
FIG. 12 is an antenna efficiency graph of a WIFI-2×2 MIMO formed by a second antenna unit and a sixth antenna unit of an antenna system of the present disclosure.

The second antenna unit 3 and the sixth antenna unit 7 that are included in the antenna system 10 provided by the present disclosure are both WIFI-2×2 MIMO antennas, and each of them covers bands of WIFI 2.4 G (2.4-2.5 GHz) and WIFI 5 G (5.15-5.85 GHz). Moreover, the second antenna unit 3 includes a GPS band, and the average antenna efficiency of each antenna unit is shown in Table 2 below. Reference can be made to FIG. 12 for details.

TABLE 2

| Frequency (MHz) | Second antenna unit | Sixth antenna unit |
|---|---|---|
| 1550-1620 | 39% | |
| 2400-2500 | 31% | 19% |
| 5150-5850 | 23% | 32% |

Figure 10:
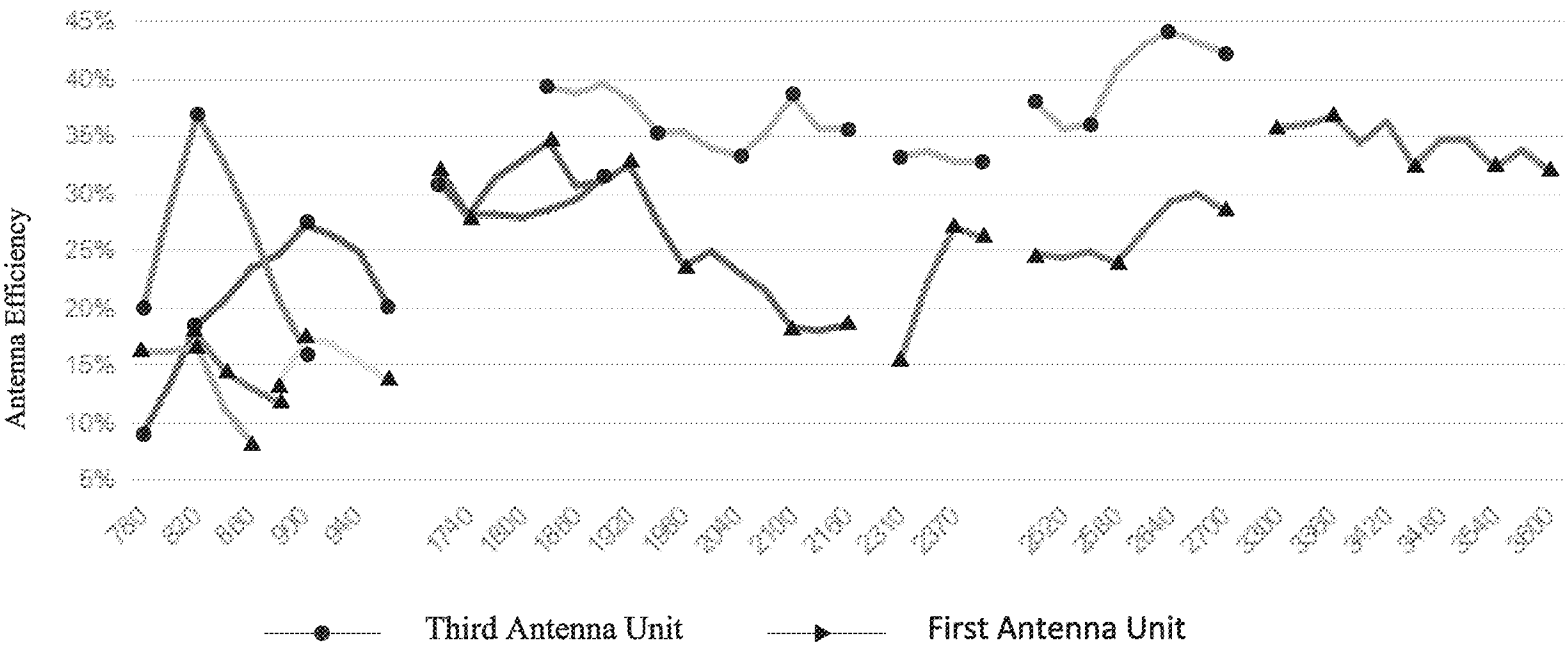
FIG. 10 is an antenna efficiency graph of a diversity antenna and a main antenna that are formed by a first antenna unit and a third antenna unit of an antenna system of the present disclosure.

The first antenna unit 2 and the third antenna unit 4 that are included in the antenna system 10 provided by the present disclosure both cover bands of (790-960 MHz, 1710-2690 MHz). The first antenna unit 2 is a diversity antenna. The third antenna unit 4 is a main antenna. 2G, 3G and 4G mobile communications can be achieved by providing the second antenna unit 2 and the third antenna unit 4. The average antenna efficiency of each antenna unit is shown in Table 3 below. Reference can be made to FIG. 10 for details.

TABLE 3

| Frequency (MHz) | Third antenna unit | First antenna unit |
|---|---|---|
| 790-960 | 26% | 14% |
| 1710-2170 | 34% | 27% |
| 2300-2690 | 38% | 25% |
| 3300-3600 | | 34% |

In summary, the antenna system 100 provided by the present disclosure, by separately providing 7 antenna units, achieves that each antenna unit covers fewer bands, thereby reducing the design difficulty and cost of each antenna unit. However, by integrating multiple antenna units, it can be achieved that the antenna system covers multiple bands simply by designing operating bands and the number of the multiple antenna units as needed.

The present disclosure also provides a mobile terminal (not shown), and the mobile terminal includes the antenna system 100 described above.

Compared with the related art, the antenna system provided by the present disclosure, by providing seven antenna units on the periphery of the non-metallic housing, achieves 3.3-3.6 GHz-4×4 MIMO, WIFI-2×2 MIMO, GPS, and 2G, 3G and 4G mobile communications.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. An antenna system, comprising:

a non-metallic housing comprising a top edge portion, a bottom edge portion provided correspondingly to the top edge portion, and a first long side edge portion and a second long side edge portion that connect the top edge portion with the bottom edge portion;

a first antenna unit provided correspondingly to the top edge portion and having coverage bands of 790-960 MHz, 1710-2690 MHz and 3.3-3.6 GHz;

a second antenna unit provided correspondingly to the top edge portion and spaced apart from the first antenna unit and having coverage bands of 1550-1620 MHz, 2400-2500 MHz, and 5.15-5.85 GHz;

a third antenna unit provided correspondingly to the bottom edge portion and having coverage bands of 790-960 MHz and 1710-2690 MHz;

a fourth antenna unit provided correspondingly to the first long side edge portion and close to the second antenna unit and having a coverage band of 3.3-3.6 GHz;

a fifth antenna unit provided correspondingly to the first long side edge portion and close to the third antenna unit and having a coverage band of 3.3-3.6 GHz;

a sixth antenna unit provided correspondingly to the second long side edge portion and close to the first antenna unit and having coverage bands of 2400-2500 MHz and 5.15-5.85 GHz; and a seventh antenna unit provided correspondingly to the second long side edge portion and close to the third antenna unit and having a coverage band of 3.3-3.6 GHz;

wherein each of the first antenna unit, the fourth antenna unit, the fifth antenna unit and the seventh antenna unit is a 3.3-3.6 GHz-4×4 MIMO antenna;

each of the second antenna unit and the sixth antenna unit is a WIFI-2×2 MIMO antenna;

the first antenna unit and the third antenna are a diversity antenna and a main antenna, respectively.

2. The antenna system as described in claim 1, wherein the non-metallic housing is a plastic housing.

3. The antenna system as described in claim 1, further comprising a top clearance region provided correspondingly to the top edge portion and a bottom clearance region provided correspondingly to the bottom edge portion, the top clearance region having a width of 6.2 mm and the bottom clearance region having a width of 3.8 mm.

4. A mobile terminal, comprising the antenna system as described in claim 1.

5. The mobile terminal as described in claim 4, wherein the non-metallic housing is a plastic housing.

6. The mobile terminal as described in claim 4, further comprising a top clearance region provided correspondingly to the top edge portion and a bottom clearance region provided correspondingly to the bottom edge portion, the top clearance region having a width of 6.2 mm and the bottom clearance region having a width of 3.8 mm.

* * * * *